US007378649B2

(12) United States Patent
Newton et al.

(10) Patent No.: US 7,378,649 B2
(45) Date of Patent: May 27, 2008

(54) SIMPLEX OPTIMIZATION METHODS FOR INSTRUMENTATION TUNING

(75) Inventors: Kenneth R. Newton, Concord, CA (US); August Specht, Walnut Creek, CA (US)

(73) Assignee: Varian, Inc., Palo Alto, CA (US)

( * ) Notice: Subject to any disclaimer, the term of this patent is extended or adjusted under 35 U.S.C. 154(b) by 318 days.

(21) Appl. No.: 11/252,000

(22) Filed: Oct. 17, 2005

(65) Prior Publication Data

US 2007/0084995 A1 Apr. 19, 2007

(51) Int. Cl.
*H01J 49/06* (2006.01)

(52) U.S. Cl. ..... 250/282; 250/283; 250/287; 250/288; 250/297

(58) Field of Classification Search ..... 250/281–300
See application file for complete search history.

(56) References Cited

U.S. PATENT DOCUMENTS

| | | | | |
|---|---|---|---|---|
| 5,457,625 | A * | 10/1995 | Lim et al. | 700/29 |
| 6,437,325 | B1 | 8/2002 | Reilly et al. | |
| 6,900,431 | B2 | 5/2005 | Belov et al. | |
| 2004/0047409 | A1* | 3/2004 | Lee et al. | 375/232 |
| 2004/0124351 | A1* | 7/2004 | Pineda | 250/288 |
| 2004/0144918 | A1* | 7/2004 | Zare et al. | 250/287 |
| 2005/0001163 | A1* | 1/2005 | Belov et al. | 250/290 |

OTHER PUBLICATIONS

Paper by Shaw, et al., entitled "Use of the Simplex Algorithm for Automated Focusing of a Mass Spectrometer Source", published by International Journal of Mass Spectrometry and Ion Processes, Jul. 1985.*

Article by Elling, et al., entitled "Computer-Controlled Simplex Optimization on a Fourier Transform Ion Cyclotron Resonance Mass Spectrometet", published by Anal. Chem, 1989, 61, 330-334.

Article by Mas, et al., entitled "99Tc Atom Counting by Quadrupole ICP-MS. Optimisation of the Instrumental Response", published by Nuclear Instruments and Methods in Physics Research A484 (2002), 660-667.

(Continued)

*Primary Examiner*—Jack I. Berman
*Assistant Examiner*—Michael J Logie
(74) *Attorney, Agent, or Firm*—Andrei D. Popovici; Bella Fishman

(57) ABSTRACT

In some embodiments, a method of optimizing operating parameters of an analytical instrument (e.g. lens voltages of a mass spectrometer) includes steps taken to minimize the method duration in the presence of substantial instrument noise and/or drift. Some methods include selecting a best point between a default instrument parameter set (vector) and a most-recent optimum parameter set; building a starting simplex at the selected best point location in parameter-space; and advancing the simplex to find an optimal parameter vector. The best simplex points are periodically re-measured, and the resulting readings are used to replace and/or average previous readings. The algorithm convergence speed may be adjusted by reducing simplex contractions gradually. The method may operate using all-integer parameter values, recognize parameter values that are out of an instrument range, and operate under the control of the instrument itself rather than an associated control computer.

20 Claims, 2 Drawing Sheets

OTHER PUBLICATIONS

Article by Evans, et al., entitled "Optimization Strategies for the Reduction of Non-Spectroscopic Interferences in Inductively Coupled Plasma Mass Spectrometry", published by Spectrochimica Acta, vol. 47B, No. 8, 1001-1012, 1992.

Article by Vertes, et al., entitled "Non-Linear Optimization of Cylindrical Electrostatic Lenses", published by International Journal of Mass Spectrometry and Ion Processes, 84 (1988) 255-269.

Article by Ford, et al., entitled "Simplex Optimization of the Plasma Parameters and Ion Optics of an Inductively Coupled Mass Spectrometer with Pure Argon and Doped Argon Plasmas, Using a Multi-Element Figure of Merit", published by Analytica Chimica Acta, 285 (1994), 23-31.

Article by Moore, GL., entitled "Use of Simplex Optimization to Improve the Performance of an Inductively Coupled Plasma in Atomic Emission Spectrometry", published by Trends in analytical Chemistry, vol. 7, No. 1, 1988, 32-35.

Article by Sartoros, et al., entitled "Program Considerations for Simplex Optimization of Ion Lenses in ICP-MS", published in Applied Spectroscopy, vol. 52, No. 5, 1998, 643-648.

Paper by Shaw, et al., entitled "Use of the Simplex Algorithm for Automated Focusing of a Mass Spectrometer Source", published by International Journal of Mass Spectrometry and Ion Processes, Jul. 1985.

Article by Wehrens, et al., entitled "Classical and Nonclassical Optimization Methods", published by Encyclopedia of Analytical Chemistry, RA Meyers (Ed.), copyright John Wiley & Sons Ltd. 2000, 9678-9689.

* cited by examiner

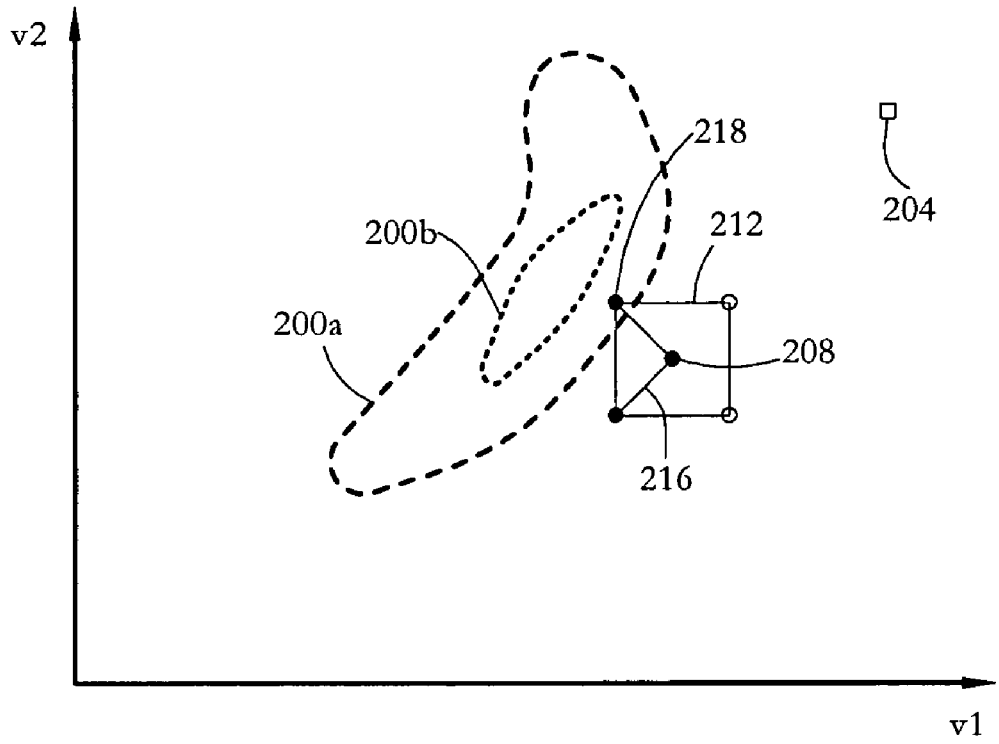
FIG. 3-A
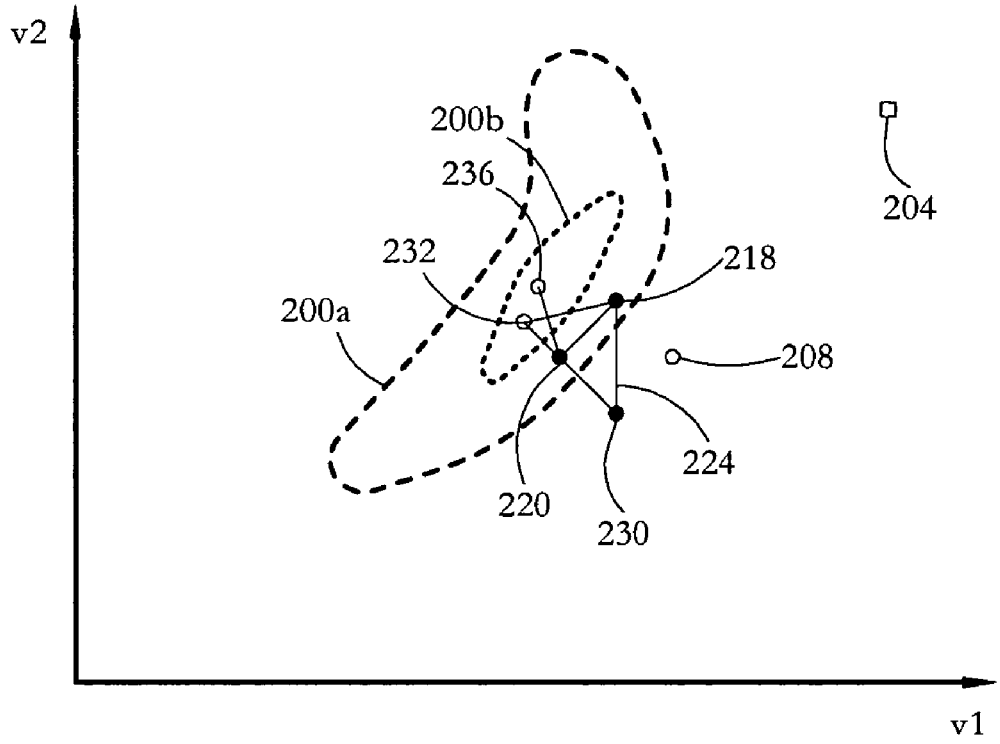
FIG. 3-B

SIMPLEX OPTIMIZATION METHODS FOR INSTRUMENTATION TUNING

BACKGROUND OF THE INVENTION

The invention relates to methods of optimizing operating parameters of analytical instruments, and in particular to systems and methods using simplex algorithms for optimizing operating parameters of mass spectrometers.

Mass spectrometers typically include multiple ion lenses and guides disposed between an ion source and an analyzer. In a common design, charged liquid droplets are generated in an ionization chamber using an atmospheric pressure ionization method such as electrospray ionization (ESI) or atmospheric pressure chemical ionization (APCI). The droplets are desolvated, and pass into a vacuum chamber through an orifice that limits the gas flow into the chamber. The ions are guided through one or more electrodynamic ion guiding structures and apertures into a mass analyzer. The signal quality of a mass spectrometer generally depends on multiple spectrometer operating parameters, such as a set of voltages applied to lensing elements positioned between the ion source and analyzer.

Several approaches have been proposed for optimizing instrument parameters such as lens voltages. In a common approach, each parameter is optimized sequentially. For example, measurements are performed for a range of first lens voltages while all other voltages are kept fixed, until a local maximum of the first voltage is found. The process is then repeated for the other lenses, and again for the whole set of lenses. Such an approach may require a relatively high number of measurements to locate an optimal parameter set.

Another optimization approach is based on the simplex family of algorithms (for simplicity, referred to hereinafter as the simplex algorithm). For a two-dimensional parameter space, the simplex algorithm has been described as a triangle flipping its way up a mountainside to find the top of the mountain. In this example, the x- and y-coordinates denote instrument parameters, while the mountain height represents the instrument figure-of-merit to be optimized. The algorithm discards the worst (lowest) point of the triangle, chooses a new point, for example by reflecting the old point with respect to the remaining two, and repeats the process until the top is found. The triangle or its equivalent in multi-dimensional space is commonly called a simplex.

References describing parameter optimization methods for mass spectrometers include Elling et al, "Computer-Controlled Simplex Optimization on a Fourier Transform Ion Cyclotron Resonance Mass Spectrometer," *Anal. Chem.* 61:330-334 (1989), Mas et al., "$^{99}$Tc Atom Counting by Quadrupole ICP-MS. Optimisation of the instrumental response," *Nuclear Instruments & Methods in Physics Research,* A484:660-667 (2002), Evans et al., "Optimization Strategies for the Reduction of Non-Spectroscopic Interferences in Inductively Coupled Plasma Mass Spectrometry," *Spectrochimica Acta,* 47B(8): 1001-1012 (1992), Vertes et al., "Non-Linear Optimization of Cylindrical Electrostatic Lenses," *International Journal of Mass Spectrometry and Ion Processes,* 84:255-269 (1988), and Ford et al., "Simplex Optimization of the Plasma Parameters and Ion Optics of an Inductively Coupled Mass Spectrometer with Pure Argon and Doped Argon Plasmas, using a Multi-Element Figure of Merit," *Analytica Chimica Acta,* 285:23-31 (1994).

Optimizing mass spectrometer parameters may be particularly difficult in the presence of noise and instrument drift, which may significantly affect instrument performance.

SUMMARY OF THE INVENTION

According to one aspect, a mass spectrometry method comprises performing mass-spectrometry measurements to evaluate a default mass spectrometer configuration parameter vector and a most-recent optimal mass spectrometer configuration parameter vector; selecting one of the default mass spectrometer configuration parameter vector and the most-recent optimal mass spectrometer configuration parameter vector as a starting parameter vector; constructing a starting simplex proximal in parameter-space to the starting parameter vector; and performing a simplex optimization using the starting simplex to generate an updated optimal mass spectrometer configuration parameter vector.

According to another aspect, a mass spectrometry method comprises advancing a simplex comprising a set of mass spectrometer configuration parameter vectors, and periodically re-measuring a best-point subset of the simplex.

According to another aspect, a mass spectrometry method comprises constructing a sampling distribution in an N-dimensional parameter space, N>1, wherein the sampling distribution comprises a center and a plurality of external points disposed around the center, wherein for each of N parameter axes, the plurality of external points includes at least two points having axis coordinates on opposite sides of the center; constructing a starting simplex by selecting a substantially non-degenerate subset of N+1 points from the center and at least a subset of the plurality of external points; and advancing the starting simplex to generate an optimal mass spectrometer configuration parameter vector.

BRIEF DESCRIPTION OF THE DRAWINGS

The foregoing aspects and advantages of the present invention will become better understood upon reading the following detailed description and upon reference to the drawings where:

FIG. 3-A illustrates an exemplary 2-D simplex starting configuration according to some embodiments of the present invention.

FIG. 3-B illustrates exemplary simplex configurations generated by advancing the configuration of FIG. 3-A, according to some embodiments of the present invention.

DETAILED DESCRIPTION OF THE INVENTION

In the following description, a set of elements includes one or more elements. Any reference to an element is understood to encompass one or more elements. Unless otherwise stated, any recited electrical or mechanical connections can be direct connections or indirect connections through intermediary structures. Unless otherwise specified, a simplex method or algorithm is a recursive method in which an inferior subset of parameter points (vectors), as measured by a metric of interest, is replaced by a new subset of parameter points. The term hypercube encompasses squares, cubes, and higher-dimensional hypercubes. The term cuboid encompasses hypercubes (e.g. squares, cubes) as well as cuboids with unequal sides (e.g. rectangles, rectangular boxes).

The following description illustrates embodiments of the invention by way of example and not necessarily by way of limitation.

Figure 1:
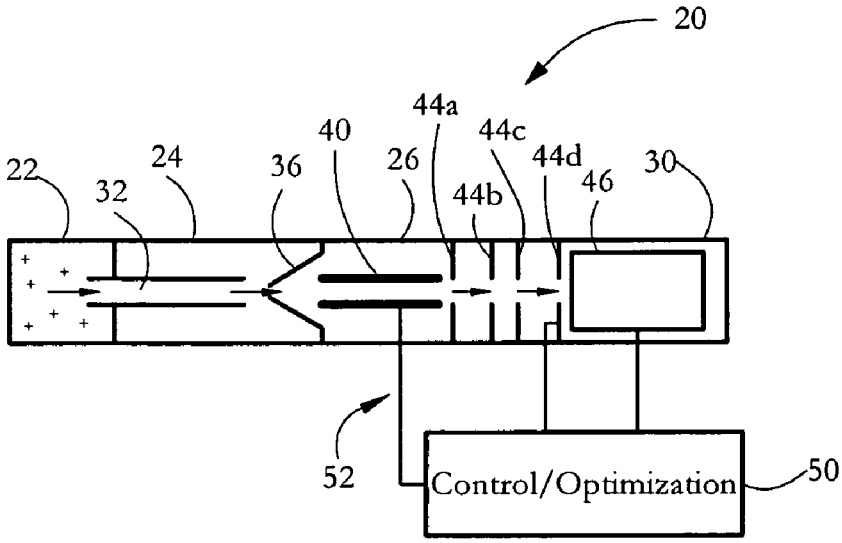
FIG. 1 is a schematic diagram of an exemplary mass spectrometry analysis apparatus according to some embodiments of the present invention.

FIG. 1 is a schematic diagram of an exemplary mass spectrometer 20 and associated control/optimization unit 50 according to some embodiments of the present invention. Spectrometer 20 includes a plurality of chambers and associated pumps, guiding components, and analysis components shown in FIG. 1. An ionization chamber (source) 22 is used to generate ions of interest. The ions may be generated using an atmospheric pressure ionization method such as electrospray ionization (ESI) or atmospheric pressure chemical ionization (APCI), among others. Ionization chamber 22 is connected to an inlet vacuum chamber 24 through an orifice 32 that limits the flow of gas into vacuum chamber 24. Orifice 32 may be defined by an elongated tube connecting chambers 22, 24. A guide vacuum chamber 26 is fluidically connected to first vacuum chamber 24 through an aperture defined in a skimmer cone 36. Guide vacuum chamber 26 encloses an electrodynamic ion guiding structure (guide) 40, for selectively guiding ions of interest from the outlet side of skimmer cone 36 to a series of apertures defined by a sequence of lensing structures 44*a-d*. An analysis chamber 30 contains a mass analyzer and an ion detector, shown schematically at 46.

During the operation of mass spectrometer 20, a set of voltages are applied to lensing/guiding elements such as ion guide 40 and lensing structures 44*a-d*. In some embodiments, the set of voltages may include a number between 2 and 6 voltage values, or higher numbers of voltage values. In some embodiments, a set of supplemental wave parameters are used in the operation of the mass analyzer shown at 46. Supplemental wave parameters may include amplitudes and phases of additional waveforms used in the mass analyzer. A control/optimization unit 50 is connected to spectrometer 20, controls the voltages applied to the lensing elements 40, 44*a-d* of spectrometer 20, and receives measurement data from the analyzer/detector 46. The received data includes signal strengths for ions of a given mass or mass range, which in some embodiments provides the metric of interest for a lens voltage optimization process. In some embodiments, a metric such as signal-to-noise (S/N) ration may be used for the lens voltage optimization. In some embodiments, an optimization of supplemental wave parameters is performed according to received signals indicative of instrument resolution and mass stability. The following discussion will focus on lens voltage optimization, but the described steps may be employed to optimize other instrument parameters.

In some embodiments, control/optimization unit 50 comprises a general-purpose computer programmed to perform the steps described below. In some embodiments, control/optimization unit 50 may include special-purpose hardware, and/or may be provided as part of spectrometer 20. In some embodiments, control/optimization unit 50 performs a number of simplex parameter optimization steps under the control of spectrometer 20: spectrometer 20 performs measurements for a given parameter set (vector), provides the measurement results to control/optimization unit 50, and requests control/optimization unit 50 to suggest a new parameter set (vector) to be evaluated. That is, software on spectrometer 20 makes function calls to software on control/optimization unit 50 to request new points to be evaluated, until a verification function call indicates that the process has converged or an error has occurred. In some embodiments, control/optimization unit 50 controls the operation of spectrometer 20, and requests measurements to be performed by spectrometer 20.

Figure 2:
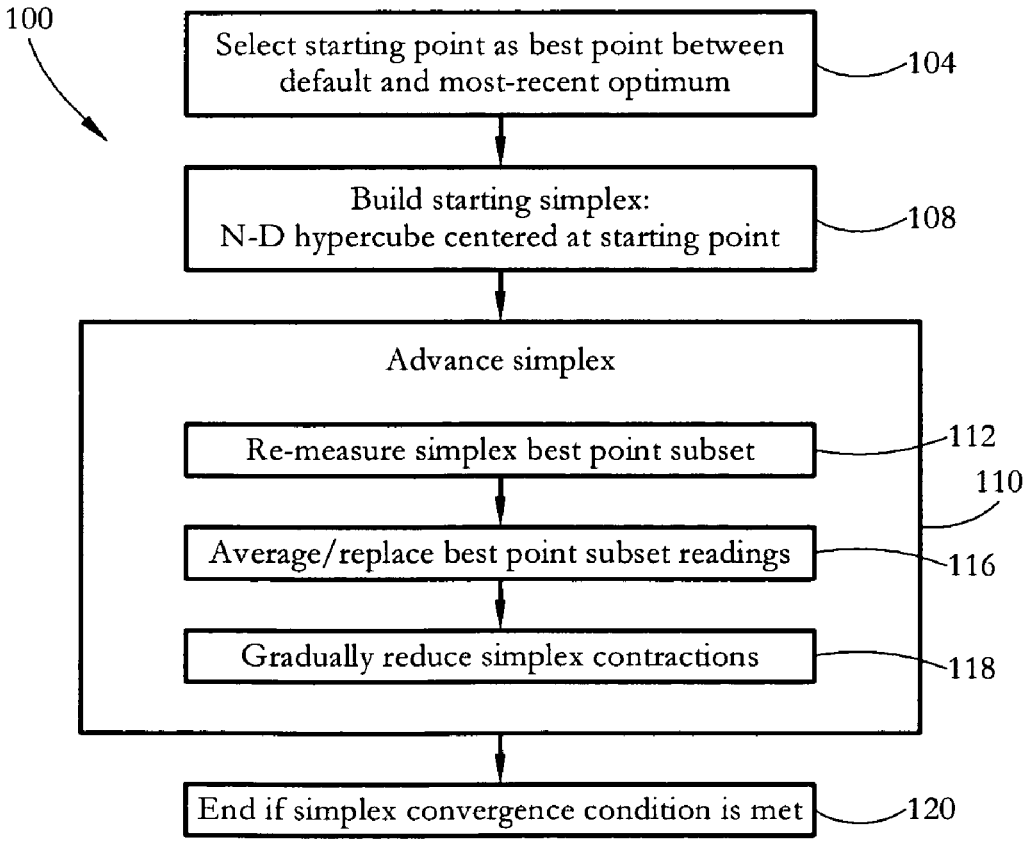
FIG. 2 shows a sequence of steps performed in a simplex optimization method according to some embodiments of the present invention.

FIG. 2 shows a sequence of steps 100 performed by control/optimization unit 50 in conjunction with spectrometer 20 in some embodiments of the present invention. In a step 104, control/optimization unit 50 selects a starting point for a subsequent simplex optimization process. The starting point is a set of parameter (e.g. lens voltage) values, which may be thought of as a vector (point) in N-dimensional space, wherein N is the number of parameters whose value combination is to be optimized. The starting point is selected by using spectrometer 20 to perform measurements for a default instrument parameter set, and a most-recent optimum parameter set. The parameter set that provides a superior metric of interest (e.g. signal strength) is selected as a simplex starting point. The most-recent optimum set is a result of the most-recent optimization process performed for the parameters of interest.

FIGS. 3-A-B illustrate schematically an exemplary instrument default point 204 and an exemplary most-recent optimum point 208, for a 2-D parameter-space defined by two parameters, v1 and v2. The curves 200*a-b* represent progressively higher levels of the instrument metric of interest, e.g. signal strength. If, for example, the instrument metric of interest is measured to be higher for the point 208, the point 208 is selected as a starting point for a subsequent simplex optimization process.

In a step 108 (FIG. 2), control/optimization unit 50 builds a starting simplex around the selected starting point. In some embodiments, the starting simplex is built from an N-dimensional hypercube centered about the selected starting point. First, the best corner of the hypercube is identified by performing measurements at all corners. The starting simplex is chosen to include the best N+1 points selected from the best corner, all corners adjacent to the best corner, and the center point of the hypercube. In an exemplary 2-D arrangement, as shown in FIG. 3-A, a starting simplex 216 (denoted by filled-in circles) may be built using point 208 and the corners of a square 212 centered at point 208. If the best corner is a point 218, the starting simplex 216 is chosen to include the best three points selected from point 218, center point 208, and the two corners adjacent to corner point 218.

The sides of the N-D hypercube may be chosen to be a fraction of the maximum range of expected variation in instrument parameter values, e.g. between 10% and 80% of the expected variation, more particularly about 30-50% of the expected variation. In some instruments, the expected voltage variation may be on the order of tens of volts for some lenses and on the order of volts for others; in some instruments, expected voltage variations may be on the order of hundreds of volts. In some embodiments, the starting simplex may be built using an N-dimensional cuboid. An N-dimensional cuboid is a rectangle in 2-D, and a rectangular parallelepiped (rectangular box) in 3-D. The term cuboid, as used herein, encompasses hypercubes (e.g. squares, cubes) as well as cuboids with unequal sides. For simplicity, the following discussion will focus on a hypercube, although the described approach can be extended to an N-dimensional cuboid.

The N-dimensional cuboid approach described above may be extended to other external sampling distributions that need not form right angles in N-dimensional parameter space. An example of such a sampling distribution is an N-dimensional parallelepiped that need not have right angles. Another example of such a distribution is a quasispherical N-dimensional distribution. To sample both directions along each parameter axis relative to the sampling distribution center (e.g. the hypercube center), the sampling distribution points are chosen so that, for any of the parameter axes, the sampling distribution includes at least two points whose axis coordinates are on opposite sides of the sampling distribution center. The starting simplex is chosen to include N+1 points selected from the distribution center, the best external point, and a set of immediate neighbors of the best external point.

The starting simplex may also be chosen from the center, the best external point, and the subset of points situated on the same side as the best external point relative to the distribution center, as measured along an N-dimensional line connecting the distribution center and the best external point. More generally, the starting simplex may also be chosen from the center and from at least a subset of external points (e.g. from all the external points, or a subset of external points). The subset may one described above—e.g. points on the same side, or neighbors of the best external set. In an approach in which the starting simplex is selected from points on the same side or from other more expansive subsets of all external points, the starting simplex may not be automatically non-degenerate. Thus, if such a selection approach is used, it may be coupled with testing for substantial non-degeneracy of the starting simplex. A test for substantial non-degeneracy may require that the hypervolume enclosed by the starting simplex be at least some a predetermined fraction of the hypervolume enclosed by the external points. If a tentative starting simplex is close to degeneracy or exactly degenerate, one or more of the tentative simplex vertices may be replaced to generate a non-degenerate starting simplex.

Control/optimization unit 50 and spectrometer 20 are used to advance the simplex (step 110, FIG. 2). Advancing the simplex may include several techniques, such as straight reflection (in 2-D, flipping the simplex triangle), contraction (in 2-D, bringing the worst point closer to the other two), reflection and contraction (in 2-D, flipping the triangle and bringing the flipped vertex closer to the pivot line), reflection and expansion (in 2-D, flipping the triangle and taking the flipped vertex further away from the pivot line), contract-to-best (in 2-D, keeping the best point and sliding the other two points to a new parallel line closer to the best point), and others. For example, in some embodiments, the algorithm may first attempt a straight reflection; if the new point is worse than the discarded point, the algorithm evaluates a contraction; if the contracted point is better than the discarded point, the contracted point is kept; if not the algorithm contracts-to-best. The algorithm may evaluate a reflection-and-expansion if the straight reflection is better than the discarded point by more than a threshold. As a skilled artisan would appreciate, other simplex advancement approaches are suitable for use in methods of the present invention.

FIG. 3-B shows several parameter vectors generating by advancing the starting simplex 216 (FIG. 3-A). A simplex 224 is generated by discarding the worst point 208 of simplex 216, and reflecting point 208 with respect to the line between the other simplex points 218, 230. The current worst point 230 is discarded, and a new simplex parameter vector 232 is generated by a reflection-and-contraction. In a subsequent step, the current worst point 220 is discarded, and a new vector 236 is generated by another reflection-and-contraction. As described below, the contraction used to generate vector 236 may be less severe than the contraction used to generate vector 232. If a simplex convergence condition is met, the process ends (step 120), and vector 236 is chosen as an optimal configuration parameter vector. The configuration parameter set defined by vector 236 is used in subsequent mass spectrometry measurements performed on samples.

Advancing the simplex includes employing spectrometer 20 to re-measure the figure-of-merit (e.g. signal strength) for the best simplex point or a best-point subset at frequent intervals (step 112). For example, re-measuring may be performed every time the simplex advances, or every time the best point in the simplex changes. In some embodiments, more than one simplex point may be re-measured. The set of re-measured points may include the best point, or a subset of points which does not include the worse simplex point or points.

In a step 116 the re-measurement results are used to replace or average the previous measurement results. If instrument noise is of primary concern, averaging may be used instead of replacement. If instrument drift is of primary concern, replacement may be used instead of averaging.

In a step 118, the algorithm convergence speed is adjusted by gradually reducing the simplex contractions that would otherwise occur as the optimum parameter region becomes near. In some embodiments, the optimization process ends when the simplex size (e.g. the mean N-dimensional distance of the simplex points from their center) has been reduced below a threshold, or when the response value at all simplex points is within a defined percentage of their mean (step 120). For example, for a lens tuning optimization application, the process may be stopped when a sum of lens voltage variations across the simplex is less than 1 V. The process may also be set to stop after a fixed number of iterations. The convergence speed adjustment step 118 gradually reduces the simplex contraction as the minimum size threshold approaches. For example, if a 50% contraction is used initially, the simplex contraction is gradually reduced to 40%, 30%, 20% and 10% as the simplex size approaches a minimum size threshold. The adjusted convergence speed helps prevent the simplex from terminating too quickly in the presence of instrument noise.

In some embodiments, control/optimization unit 50 constrains all optimization parameters to integer values, rather than floating point variables. Some mass spectrometers employ only integer values for control. Control/optimization unit 50 may be configured to prevent producing degenerate simplexes (e.g. a line instead of a triangle in 2D) when constraining parameter values to integers.

In some embodiments, control/optimization unit 50 includes stored data of optimization parameter ranges allowed by spectrometer 20. Consequently, an attempted advance of the simplex that would result in an out-of-range parameter value is re-processed by control/optimization unit 50 preemptively, without asking spectrometer 20 for a measurement and receiving an error in response.

The preferred systems and methods described above allow substantially reducing the time required to optimize mass spectrometer parameters in the presence of substantial instrument noise and/or drift. The time required to perform a mass spectrometer lens voltage optimization in general may depend on multiple factors, including the number of voltages to be optimized. In some instances, particularly if higher numbers of voltages were to be optimized, a conventional sequential-scanning optimization technique could take on the order of many minutes, for example 20-30 minutes, to find an acceptable optimal parameter set. Such optimization processes may use on the order of hundreds of spectrometer readings to reach an acceptable optimal value set.

The optimization process may be particularly difficult in the presence of noise and/or drift, which lead to time-dependent measurement results. Some ionization techniques, such as ESI, may inherently introduce large noise spikes in the system. In some instances, air bubbles produce completely erroneous signal values. It is not uncommon for mass spectrometer noise levels to be 10% or more of the available signal. In a 2-D parameter-space example, such noise can be viewed as fluctuations or ripples in the slope of the hill to be climbed by the flipping simplex triangle. The fluctuations can be large enough to temporarily reverse the slope direction, and drive the triangle away from the peak of the hill. Such fluctuations may be particularly noticeable and damaging in the flatter part of the parameter-space topography. Is it common for the parameter space of a mass spectrometer to contain a relatively-flat large area of parameter space, and a relatively small steep mountain centered around the instrument maximum. It was observed that for a conventional simplex optimization technique, the levels of noise and/or drift often prevented the algorithm from converging within a useful time, or from converging at all to an instrument maximum.

Evaluating both the instrument default and the most-recent optimum points allows reducing the time spent by the simplex optimization process in the flat part of the parameter-space topography. Instrument lenses get dirty or otherwise change over time, and in many instances the most-recent optimum is a good starting point for the simplex optimization process. At the same time, instrument parameters may also sometimes be significantly reset, for example if the lenses are cleaned, parts are replaced, or the instrument has been serviced. In such instances, the instrument default parameter vector may provide a significantly-better starting point than the most-recent optimum. Starting out in the steeper part of the parameter-space topology is particularly valuable in the presence of high levels of noise, which make advancing through the flat part of the topology particularly difficult.

Periodically re-measuring the best simplex points or a best-point subset also serves to reduce the effects of noise and/or drift, particularly in the flatter part of the parameter-space topology. The instrument response may drift with time during the parameter optimization process, and may be subject to significant noise. Consequently, a relatively good measurement value generated early in the process may become locked in, and prevent the algorithm from converting to a true maximum. Averaging-in re-measurement values reduces the effects of noise and drift. The effects of drift are also reduced by using re-measurement values as replacements. The re-measurement steps introduce a relatively low overhead, and prevent erroneous readings from becoming locked in as local peaks.

Adjusting the convergence condition to reduce simplex contractions as the simplex gets smaller is of particular use in mitigating the effects of noise in the steeper part of the parameter-space topology, closer to the instrument optimum.

The above embodiments may be altered in many ways without departing from the scope of the invention. For example, the tuning methods described above may be applied to other analytical instruments, such as instruments requiring the alignment of lenses. Accordingly, the scope of the invention should be determined by the following claims and their legal equivalents.

What is claimed is:

1. A mass spectrometry method comprising:

performing mass-spectrometry measurements to evaluate a default mass spectrometer configuration parameter vector and a most-recent optimal mass spectrometer configuration parameter vector;

selecting one of the default mass spectrometer configuration parameter vector and the most-recent optimal mass spectrometer configuration parameter vector as a starting parameter vector according to a result of the mass-spectrometry measurements;

constructing a starting simplex proximal in parameter-space to the starting parameter vector; and performing a simplex optimization using the starting simplex to generate an updated optimal mass spectrometer configuration parameter vector.

2. The method of claim 1, further comprising performing a mass spectrometry measurement on a sample using the updated optimal mass spectrometer configuration parameter vector.

3. The method of claim 1, wherein the optimal mass spectrometer configuration parameter vector comprises a plurality of mass spectrometer lens voltages.

4. The method of claim 1, wherein the optimal mass spectrometer configuration parameter vector comprises a plurality of mass analyzer waveform parameters.

5. The method of claim 1, wherein performing the simplex optimization comprises periodically re-measuring a best-point subset of an advancing simplex.

6. The method of claim 5, wherein performing the simplex optimization comprises averaging a result of an original measuring of the best-point subset with a result of said re-measuring the best point subset.

7. The method of claim 5, wherein performing the simplex optimization comprises replacing a result of an original measuring of the best point subset with a result of said re-measuring the best point subset.

8. The method of claim 5, wherein the best-point subset consists of a simplex best point.

9. The method of claim 1, wherein performing the simplex optimization comprises adjusting a convergence speed of the simplex optimization by reducing a contraction fraction with a size of a simplex used in the simplex optimization.

10. A mass spectrometry method comprising:

advancing a simplex comprising a set of mass spectrometer configuration parameter vectors; and periodically re-measuring a best-point subset of the simplex.

11. The method of claim 10, wherein advancing the simplex comprises averaging a result of an original measuring of the best-point subset with a result of said re-measuring the best point subset.

12. The method of claim 10, wherein advancing the simplex comprises replacing a result of an original measuring of the best point subset with a result of said re-measuring the best point subset.

13. The method of claim 10, wherein the best-point subset consists of a simplex best point.

14. The method of claim 10, further comprising performing a mass spectrometry measurement on a sample using an optimal mass spectrometer configuration parameter vector generated by advancing the simplex.

15. The method of claim 10, wherein advancing the simplex comprises adjusting a convergence speed by reducing a simplex contraction fraction with a size of the simplex.

16. The method of claim 10, wherein each of the mass spectrometer configuration parameter vectors comprises a plurality of mass spectrometer lens voltages.

17. The method of claim 10, wherein each of the mass spectrometer configuration parameter vectors comprises a plurality of mass analyzer waveform parameters.

18. A mass spectrometry method comprising:

constructing a sampling distribution in an N-dimensional parameter space, N>1, wherein the sampling distribution comprises a center and a plurality of external points disposed around the center, wherein for each of N parameter axes, the plurality of external points includes at least two points having axis coordinates on opposite sides of the center;

constructing a starting simplex by selecting a substantially non-degenerate subset of N+1 points from the center and at least a subset of the plurality of external points; and advancing the starting simplex to generate an optimal mass spectrometer configuration parameter vector.

19. The method of claim 18, wherein constructing the starting simplex comprises selecting the substantially non-degenerate subset of N+1 points from the center, a best external point, and a set of neighbors of the best external point.

20. The method of claim 19, wherein:

the sampling distribution comprises an N-dimensional cuboid; and the set of neighbors of the best external point comprises a set of neighboring corners of a best corner.

* * * * *